US007946968B2

(12) United States Patent
Kjellberg

(10) Patent No.: US 7,946,968 B2
(45) Date of Patent: May 24, 2011

(54) EXERCISE APPARATUS AND A WEIGHT SELECTION SYSTEM

(75) Inventor: Otto Kjellberg, Lindkoping (SE)

(73) Assignee: Mats Thulin AB, Danderyd (SE)

( * ) Notice: Subject to any disclaimer, the term of this patent is extended or adjusted under 35 U.S.C. 154(b) by 0 days.

(21) Appl. No.: 12/641,431

(22) Filed: Dec. 18, 2009

(65) Prior Publication Data

US 2010/0227745 A1 Sep. 9, 2010

(30) Foreign Application Priority Data

Mar. 9, 2009 (SE) ..... 0900300

(51) Int. Cl.
*A63B 21/00* (2006.01)

(52) U.S. Cl. ..... 482/99; 482/100; 482/106

(58) Field of Classification Search ..... 482/94–106
See application file for complete search history.

(56) References Cited

U.S. PATENT DOCUMENTS 5,123,885 A * 6/1992 Shields ..... 482/106
5,306,221 A * 4/1994 Itaru ..... 482/98
6,468,189 B2 * 10/2002 Alessandri ..... 482/99
D519,173 S 4/2006 Nalley
7,608,021 B1 10/2009 Nalley
2007/0004569 A1 1/2007 Cao
2008/0305936 A1 12/2008 Cao

FOREIGN PATENT DOCUMENTS

WO 2006/065954 6/2006

OTHER PUBLICATIONS

International Search Report corresponding to PCT/SE2010/050268 mailed May 11, 2010.

* cited by examiner

*Primary Examiner* — Jerome W Donnelly
(74) *Attorney, Agent, or Firm* — Renner, Otto, Boisselle & Sklar, LLP

(57) ABSTRACT

The present invention relates to an exercise apparatus comprising a weight stack for opposing a given exercise motion through a cable and pulley system. The weight stack comprises a set of weights vertically stacked on each other. The weights have a central aperture formed therein through which a lifting stem is downwardly insertable. Each weight is provided with weight selector means, which are pivotally engagable with said lifting stem for connecting and locking a selectable number of weights to the central lifting stem.

9 Claims, 4 Drawing Sheets

EXERCISE APPARATUS AND A WEIGHT SELECTION SYSTEM

Figure 1:
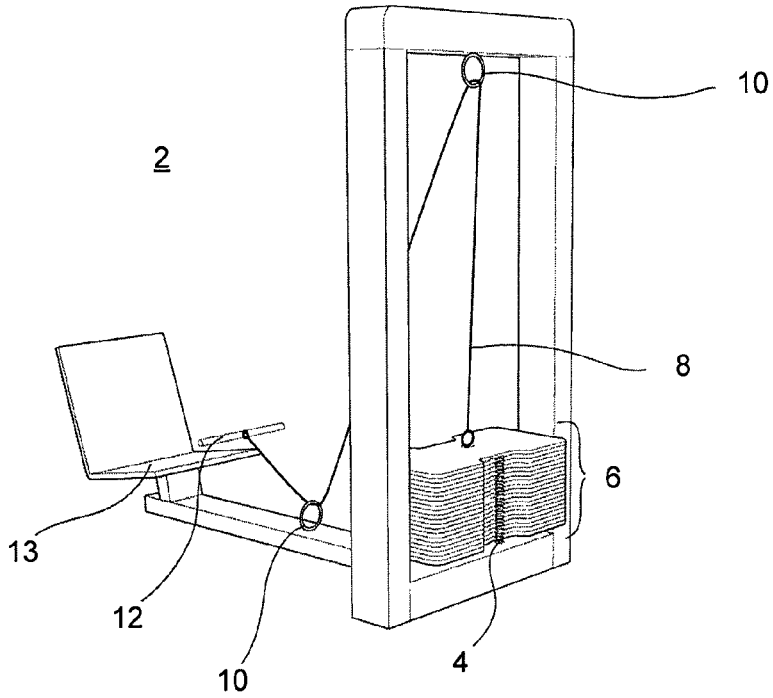

The present invention relates generally to an exercise apparatus, and more particularly to a weight selection system, with which a user can select a desired amount of weight from a stack of weights.

To be able to select a desirable amount of weight is a common feature in almost all exercise apparatuses. One widely spread method is to use a stem that goes down through central apertures provided in each plate of the weight stack and wherein an insertion pin can be inserted through a hole on the side of each weight plate and a corresponding hole in the stem. When the insertion pin is inserted in the side hole of the weight plate and through the corresponding hole in the stem it will pickup the weight in which it has been inserted and all the weights that are placed above this plate of the weight stack, when a user pulls up the weight stack. Thus, all the plates that are below the insertion pin will not be selected.

There are several problems with this popular weight selection system. One problem is that the side hole of the weight plate must be aligned with the corresponding hole in the stem. The extent of this problem will vary depending on the allowed tolerance of the thickness of the weight plates. Due to the accumulated thickness deviation this problem is usually most severe for the top or bottom one or two holes of the central stem. This will cause a problem for a user trying to insert the insertion pin in these holes. The easiest way to solve this problem is to use very tight tolerances during the manufacturing of the weight plates. However, the big disadvantage with this solution is of course that this will increase the overall costs for the exercise apparatus.

A second problem is that the insertion pin easily gets lost. One solution to this problem is to use a cable and tie it to the exercise machine. Even if this is done, it sometimes happens that the cable is cut away to make it user-friendlier.

A third problem is that a user needs to get close to the weight stack when he changes his training load. If another person for some reason operates the exercise machine during that time, there is a possibility that the user gets hurt or squeezed by falling weights.

Thus, there is a need for an exercise machine, where the tolerances of the weight plates are not crucial to the function of the weight stack. There is also a need for a solution where the pin or other weight selection mechanism cannot get lost and thus jeopardize the function of the exercise machine. It would also be desirable with an exercise machine which is safe and where the weights can be selected without the danger of getting hurt.

Thus, the objective problem to be solved by the present invention is to accomplish an exercise machine with weight selector means that are very reliable and where parts of the weight selection system cannot get lost, even if there are some variations in tolerance for the individual weight plates in the weight stack.

The present invention solves this problem by providing an exercise apparatus having a weight stack comprising a set of weights vertically stacked on each other, which weights have a central aperture formed therein through which a lifting stem is downwardly insertable and wherein each weight is provided with weight selector means, which are pivotally engagable with said lifting stem for connecting and locking a selectable number of weights to the central lifting stem.

According to a second aspect of the present invention there is provided an exercise apparatus, wherein the weight stack is protected with a cover for preventing a user to come close to the weight stack and wherein the weight selector means are actuatable from the outside of the cover by means of an actuating rod.

Figure 2:
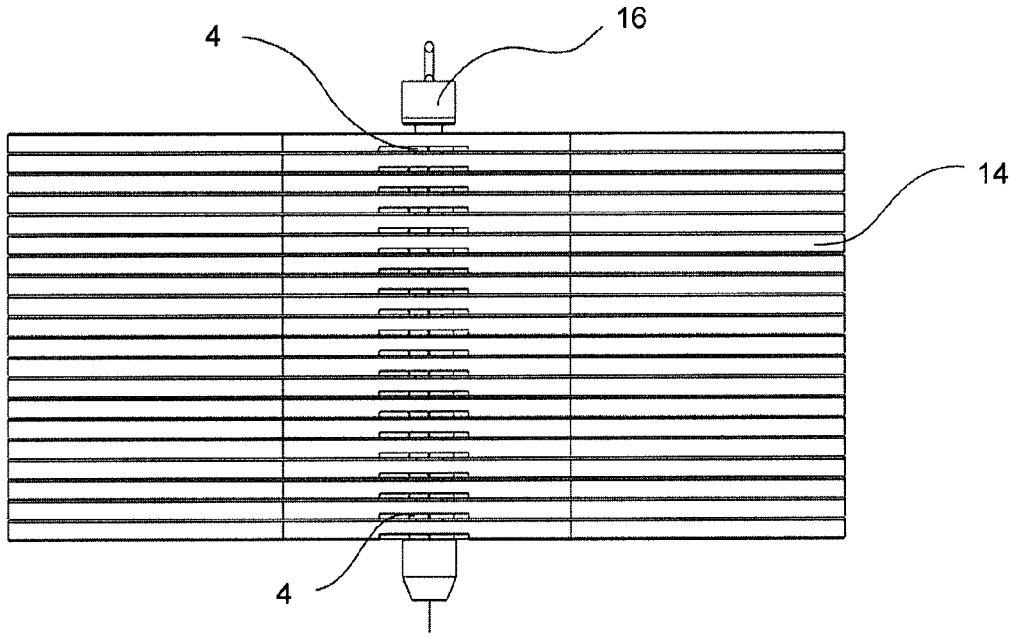
Figure 3:
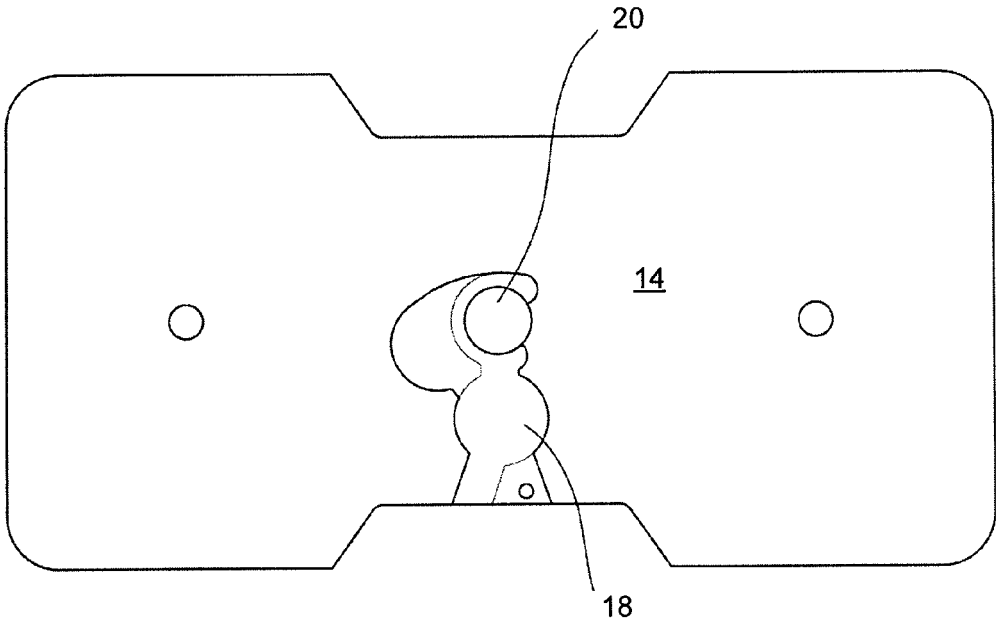
Figure 4:
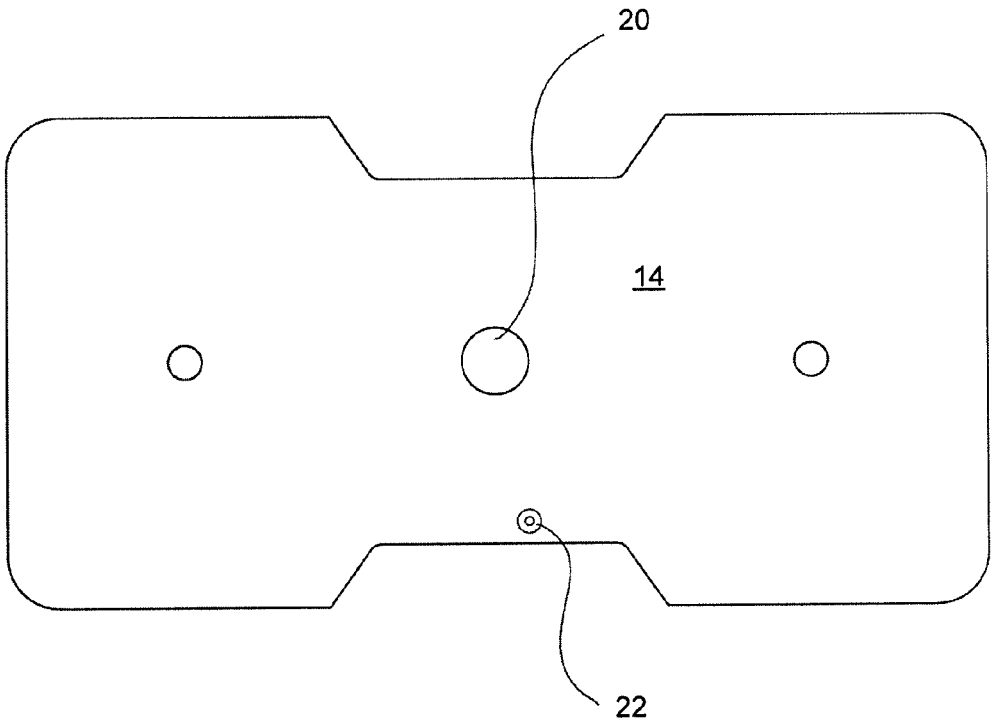
Figure 5:
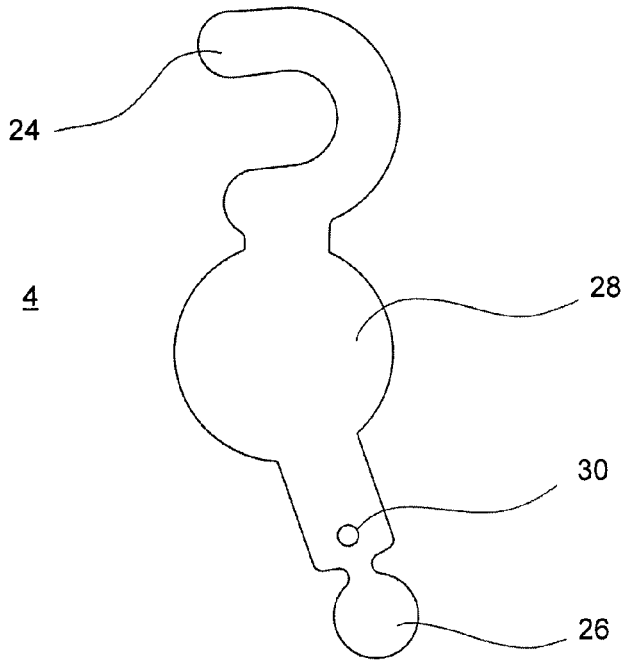
Figure 6:
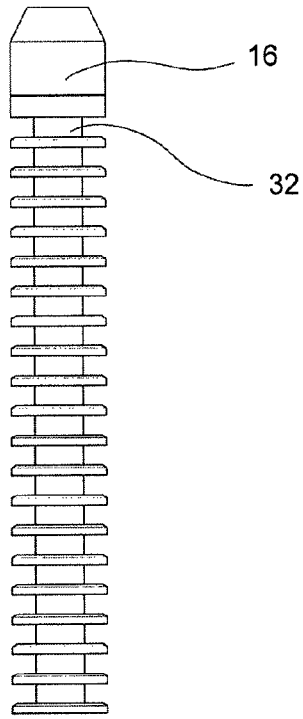
Figure 7:
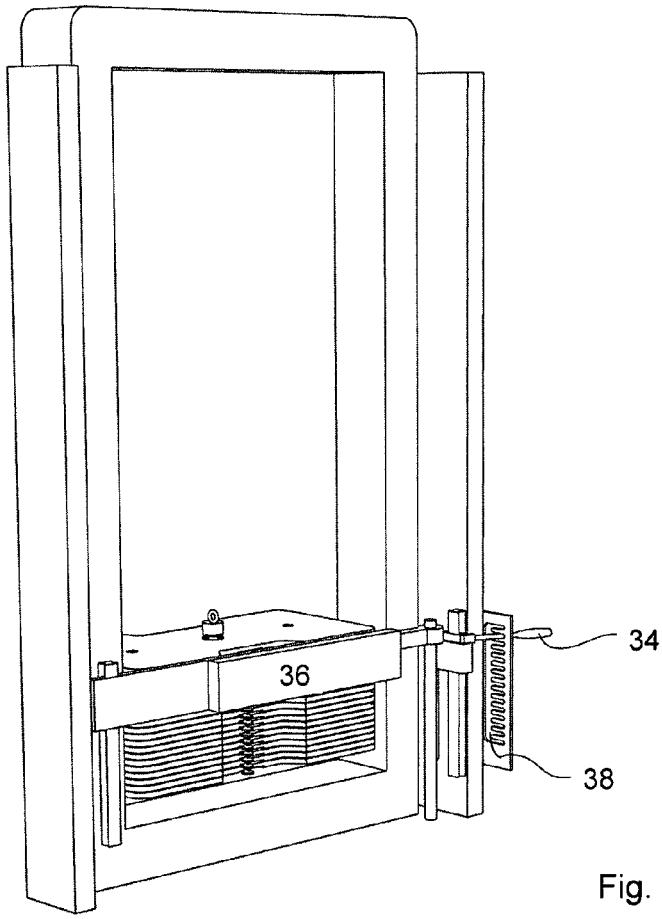
Figure 8:
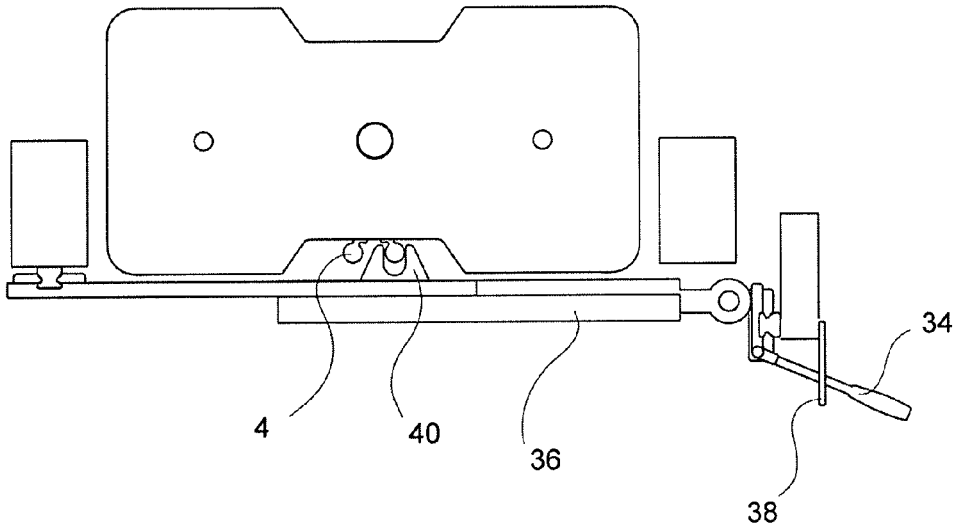

Further objects, features, and advantages of the invention will appear from the following description of several embodiments of the invention, wherein various aspects of the invention will be described in more detail with reference to the accompanying drawings, in which:

FIG. 1 shows a perspective view of an exercise apparatus having the weight selector means according to the present invention, FIG. 2 shows a front view of the weight stack of the exercise apparatus according to the present invention, FIG. 3 is a bottom view of a single weight plate showing the two different levels of the recess formed therein, FIG. 4 is a top view of the single weight plate showing the locking means provided thereon, FIG. 5 shows a detailed view of the weight selector means, FIG. 6 shows a detailed view of the lifting stem, FIG. 7 shows the weight stack and the actuating rod through which the weight selector means are actuatable, and FIG. 8 is a view from above of the weight stack showing the driver and the claw member for actuating the weight selector.

FIG. 1 shows a perspective view of an exercise apparatus 2 having weight selector means 4 according to the present invention. The exercise apparatus further comprises a weight stack 6, a cable 8, a pulley system 10 and a handle 12. The weight stack 6 is used to oppose a given exercise motion, exerted by a user pulling the handle 12, through the cable 8 and pulley 10 system. The exercise apparatus 2 may also comprise a seat 13 on which the user may sit when he or she is performing the exercise motion. There is no obligation that the exercise apparatus comprises a seat 13. The use of a seat 13 or other supports, such as breast supports, leg supports etc. is dependent on the type of exercise machine 2 used. It should be understood that the weight selection means according to the present invention is not dependent on the type of exercise apparatus 2 used and may be used with any exercise apparatus as long as it is provided with a weight stack.

FIG. 2 shows a detailed front view of the weight stack 6 itself. The weight stack 6 comprises a set of individual weight plates 14 vertically stacked on each other. The number of weight plates 14 is dependent on the type of exercise apparatus and the type of load that a user desires. As is clearly evident by FIG. 2, each individual weight plate 14 is provided with its individual weight selector means 4. FIG. 2 also gives an indication of a lifting stem 16 that is inserted through central apertures provided in the individual weight plates 14. The weight selector means 4 are pivotally engagable with the lifting stem 16 for connecting and locking a selectable number of weights to the central lifting stem 16. The design of the lifting stem 16 will be more closely described below in conjunction with FIG. 6.

FIG. 3 is a detailed bottom view of a single weight plate 14 showing a recess 18 designed for receiving the weight selector means 4. The weight selector means 4 is shown in FIG. 5. As mentioned above, each weight plate 14 comprises a through hole or an aperture 20 through which the lifting stem 16 is insertable. The aperture 20 is preferably provided in the middle of the weight plate 14 in order to balance the weight plate or plates when they are lifted. The recess 18 is provided on the underside of the weight plate 14 and is in connection with the central aperture 20. There are at least two different levels or depths of the recess 18. The recess 18 is designed in such a way that the weight selector means 4 is pivotable between two different positions, wherein a first position corresponds to when the weight selector means 4 are in a non-selected position and a second deeper position corresponds to when the weight selector means 4 are in a selected position.

When the weight selector is in the second deeper position it will safely stay there until a user changes its position. When the selected weight plates are lifted, the weight selector 4 will be pushed against the bottom of the second deeper position by the weights that it carries. Thus, it will not be possible for the weight selector 4 to "accidentally" slip into the first position during the time when the exercise motion is performed.

When the weight selector means 4 are in the first non-selected position it is important that it stays there during the exercise motion, i.e. when the selected number of weights are moved up en down. In order to secure that the weight selector means 4 are looked there is provided looking means 22 (see FIG. 4) on the topside of the weight plate 14. This means that the locking means 22 for an individual weight plate is provided on the weight plate that is lying directly underneath the weight plate in question. In a preferred embodiment of the invention the locking means 22 is a spring-biased ball, which is designed for engagement with a recess provided on the weight selector means 4, which will be described closer below in conjunction with FIG. 5.

FIG. 5 shows a detailed view of the weight selector means 4. The weight selector 4 comprises a first hook-shaped end 24, which is adapted to fit around a horizontal peripheral groove (to be described below) of the lifting stem 16. A second actuating end 26 of the weight selector 4 extends outside of the weight stack 6. The shape of the second actuating end 26 and how far it extends outside the weight stack is dependent on how the weights are being selected. If the weight is to be selected directly by the user of the exercise apparatus it may be beneficial if it is finger friendly and extends outside the weight stack long enough for a user to readily take a firm grip thereon.

In another embodiment of the present, the second actuating end 26 may have a different shape that is adapted to an end of a driver, which a user may operate through an actuating rod, one end of which is provided on a distance from the weight selector 4. This might be the case when a cover, due to safety reasons, protects the weight stack 6, i.e. when the user is prevented from coming close to the weight stack. An actuating rod may also be used when it is preferable to be able to perform the weight selection at the position where the exercise motion is carried out.

FIG. 5 further shows that the weight selector 4 comprises a middle pivoting section 28 around the axis of which the weight selector 4 is pivotable between its two positions. In a preferred embodiment of the present invention the middle pivoting section of the weight selector is circular. The weight selector 4 also, as mentioned above, comprises a recess 30 adapted for engagement with the locking means 22 provided on the upper side of each weight. However, there is no need to provide the top weight of the weight stack with the looking means, since it does not have any weight plates above it.

The weight selector 4 may have a different design than the one shown in FIG. 5. The important thing is that the selector is pivotable between two positions, one in which it is in engagement with the lifting stem 16 and one in which it is not in engagement with the lifting stem 16 and in which position it is safely kept by some locking means. Thus, there are many options for a skilled person to design the first hook-shaped end 24 and the second actuating end 26 of the weight selector 4.

FIG. 6 shows a detailed view of the lifting stem 16. The lifting stem 16 has a substantially circular cross section and comprises a number of peripheral horizontal grooves 32 corresponding to the number of weight plates in the weight stack. The grooves 32 are in alignment with the recesses 18 of the weight plate when the lifting stem 16 is fully inserted in the central apertures 20 of the weights. Thus, when the lifting stem 16 is fully inserted the desired amount of weights may be selected by turning a corresponding weight selector 4 around its pivoting axis. By doing this, the hook-shaped end 24 of the weight selector 4 will engage the lifting stem 4. The depth of the peripheral grooves may vary and be adapted to how heavy the weights are.

FIG. 7 shows the weight stack and the actuating rod 34 through which the weight selector 4 is actuatable. The actuating rod 34 is operatively connected to a driver 36, which is designed to move the weight selector 4 between its two positions. A saw tooth shaped slot 38 guides the movement of the actuating rod 34. When the actuating rod 34 rests in a tooth of said slot 38 it also, via the driver 36, holds the corresponding weight selector 4 in the second position, i.e. when the weight selector 4 is in engagement with the lifting stem 16. To change weights the actuating rod 34 is turned into the long slot of the saw tooth slot, during which movement the corresponding weight selector 4 is brought from the second to the first non-engaged position. In the long slot position the actuating rod 4 is free to run up and down in order to select the desirable weight. As soon as the desired weight has been reached the weight selector 4 may be brought into the engaged second position by turning the actuating rod 34 into the corresponding tooth of the saw tooth slot 38. Thus it is easy to select the desired number of weights from a distance, by using the actuating rod 38.

FIG. 8 is a view from above of the weight stack showing the driver 36 and a claw member 40 for actuating the weight selector 4. The shape and design of the claw member 40 is adapted to the size and design of the weight selector 4.

The use of the actuating rod 34 together with a driver and claw member 40 is very useful when the weight stack have to be protected by a cover due to safety reasons. For sake of simplicity the cover is not shown in FIG. 7 or 8.

Thus, different embodiments of the present invention have been described. However, it shall be understood that even if the invention has been described with reference to preferred embodiments the invention is not limited thereto. There are many other embodiments and variations that are likewise within the scope of the invention, which is best defined by the accompanying claims.

The invention claimed is:

1. Exercise apparatus comprising a weight stack for opposing a given exercise motion through a cable and pulley system, said weight stack comprising a set of weights vertically stacked on each other, which weights have a central aperture formed therein through which a lifting stem is downwardly insertable and wherein each weight is provided with weight selector means, which are pivotally engagable with said lifting stem for connecting and locking a selectable number of weights to the central lifting stem, and wherein the weight selector means is fitted in a recess provided on the underside of each weight, said recess being in connection with the central aperture of each weight.

2. Exercise apparatus according to claim 1, wherein the recess comprises at least two levels having different depths and wherein the weight selector means is adapted to fit in the first level, corresponding to a first position of the weight selector means, when its weight is not selected and to fit in the second deeper level, corresponding to a second position of the weight selector means, when its weight is to be selected.

3. Exercise apparatus according to claim 1, in which the lifting stem has a substantially circular horizontal cross section and comprises a number of horizontal peripheral grooves corresponding to the number of weights in the weight stack and which grooves are in alignment with said recesses when the lifting stem is fully inserted in the central apertures of the weights.

4. Exercise apparatus according to claim 3, wherein the weight selector means comprises a first hook-shaped end adapted to fit around the horizontal peripheral groove of the lifting stem, a second actuating end extending outside the weight stack and a middle pivoting section.

5. Exercise apparatus according to claim 4, wherein the middle pivoting section of the weight selector means is circular.

6. Exercise apparatus according to claim 2, wherein the weight selector means further comprises a recess adapted for engagement with locking means provided on the upper side of each weight.

7. Exercise apparatus according to claim 6, wherein the locking means is a spring-biased ball and the corresponding recess is circular.

8. Exercise apparatus comprising a weight stack for opposing a given exercise motion through a cable and pulley system, said weight stack comprising a set of weights vertically stacked on each other, which weights have a central aperture formed therein through which a lifting stem is downwardly insertable and wherein each weight is provided with weight selector means, which are pivotally engagable with said lifting stem for connecting and locking a selectable number of weights to the central lifting stem, and wherein the weight stack is protected with a cover for preventing a user to come close to the weight stack and wherein the weight selector means are actuatable from the outside of the cover by means of an actuating rod.

9. Exercise apparatus according to claim 8, wherein the actuating rod is connected to a driver which is arranged to actuate the weight selector means by means of a claw member.

* * * * *